US005117562A

United States Patent [19]

Dulay et al.

[11] Patent Number: 5,117,562

[45] Date of Patent: Jun. 2, 1992

[54] RADIANT ENERGY INK DRYING DEVICE

[75] Inventors: Robert C. Dulay, Wheeling; Andrew K. Miraldi, Marengo; Joseph A. Lafrenz, Schaumburg, all of Ill.; Robert T. Seaberg, Fontana, Wis.

[73] Assignee: Robert C. Dulay, Wheeling, Ill.

[21] Appl. No.: 339,023

[22] Filed: Apr. 14, 1989

[51] Int. Cl.[5] ..... F26B 19/00

[52] U.S. Cl. ..... 34/48; 34/60; 34/4; 34/87

[58] Field of Search ..... 34/41, 68, 4, 87, 39, 34/40, 155, 156, 44, 48, 46; 101/487, 488, 484, 424.1

[56] References Cited

U.S. PATENT DOCUMENTS 2,668,700 2/1954 Zimmerman ..... 34/41 X 4,495,713 1/1985 Williner ..... 34/41 X

OTHER PUBLICATIONS

"Drying the Infrared Way", Instant Printer, Sep. 1988.

AMJO, Inc. brochure entitled "New Small Press Drying System".

AMJO, Inc. brochure entitled "AMJO Infra-Red Drying Systems".

Installation instructions for the AMJO Infra-Red Drying System.

Tri Star Infra-Red Drying System 2 page advertisement.

Tri Star Infra-Red Drying System brochure.

Kool-Cure ® 300 UV Curing System brochure.

Herbert "Hi-Ray Infrared Dryers for Small Presses" brochure.

*Primary Examiner*—Henry A. Bennet

*Attorney, Agent, or Firm*—McDermott, Will & Emery

[57] ABSTRACT

A radiant energy ink drying device for drying ink on paper exiting a printer includes a lightbox, cooling fans for cooling the light box, and a processing unit. The processing unit controls the operation of the cooling fans based on signals received from a temperature sensor located in the drying area of the lightbox. The processing unit also deactivates the printer based on signals from a paper sensor located on the light box. In addition, an overtemperature sensor deactivates the printer when the light box housing exceeds a predetermined temperature.

10 Claims, 12 Drawing Sheets

| | | |
|---|---|---|
| FIG. 7F | FIG. 7E | FIG. 7D |
| FIG. 7A | FIG. 7B | FIG. 7C |

FIG. 7

RADIANT ENERGY INK DRYING DEVICE

BACKGROUND OF THE INVENTION

This invention relates to radiant energy drying devices, particularly radiant energy drying devices used to dry ink.

The problem of drying ink has existed for some time in the printing industry. The longer it takes for ink to dry, the longer it takes for the entire printing process to be completed. Consequently, by decreasing the drying time, the entire printing process can be completed quickly and efficiently.

Some prior art solutions to the drying problem focus on the type of ink used. Quick-drying inks have been developed, but are not very effective. Other prior art solutions center on the environment surrounding the printed material. For instance, since heat causes a chemical reaction to speed up, the chemical reaction of ink setting, or polymerization, is accelerated by heating the printed material in an appropriate manner.

Dryers using infrared radiation have been developed to generate and apply heat to printed material. The heat from an infrared dryer starts the acceleration process, causing the initial setting of the ink. However, the warmth of the stack of printed material exiting a printer continues the chemical reaction to its end point.

A problem with prior art infrared dryers is the risk of fire. If paper remains under a dryer too long, it will ignite. In addition, because of the heat involved, an operator often burns himself on the hot surfaces of the dryer. In addition, if an unsafe condition exists, there is no means for preventing the operation of the printing press. Thus, prior art infrared dryers do not provide a safe environment for the operator or for the associated printing equipment.

SUMMARY OF THE INVENTION

The present device is directed to a drying device. The device includes a light box for emitting radiant energy and means for cooling the light box. The device also includes temperature sensing means for sensing the temperature of the drying area of the light box and generating a temperature signal. The temperature signal is received by a processing means which controls the operation of the cooling means. When the temperature signal is above a predetermined threshold the processing means activates the cooling means.

An object of the present invention is to control an ink drying device in response to temperatures sensed on or near the drying device.

Another object of the invention is to identify paper jams in an ink dryer and indicate the presence of such jams.

Still another object of the invention is to indicate the temperature on or near an ink drying device.

A further object of the present invention is provide a safe device for drying ink.

An advantage of the present invention is that the temperature within a drying area may be maintained within a preselected range.

Another advantage of the invention is that a printer's drive and pump motors can be disabled when the ink drying device is operating improperly.

BRIEF DESCRIPTION OF THE DRAWINGS

FIG. 7 shows the arrangement of FIGS. 7A–F.

DETAILED DESCRIPTION OF THE PRESENTLY PREFERRED EMBODIMENT

Figure 1:
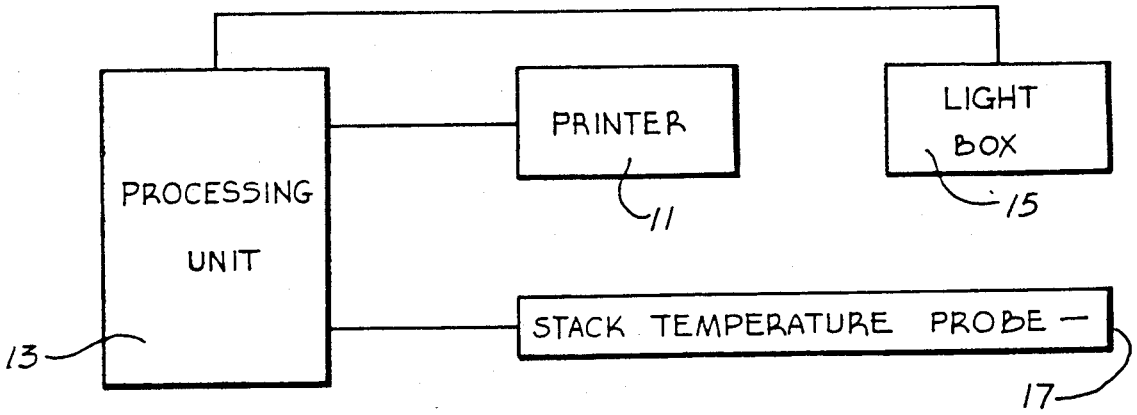
FIG. 1 shows an embodiment of the present invention for drying printed material.
Figure 3:
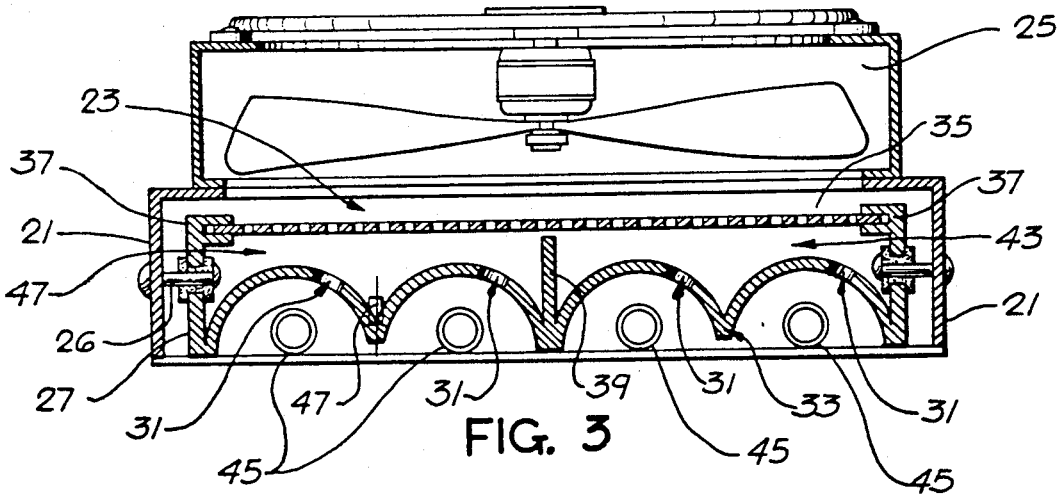
FIG. 3 is a sectional side view of the light box of FIG. 2 taken along the line 3—3.

Referring now to the drawings, FIG. 1 shows an embodiment of the present invention for use in the printing industry. The device shown in FIG. 1 dries ink after it has been printed on a substrate, such as paper, by a printer 11. The ink drying device includes a processing means 13, a light box 15, and a stack temperature probe 17.

Figure 2:
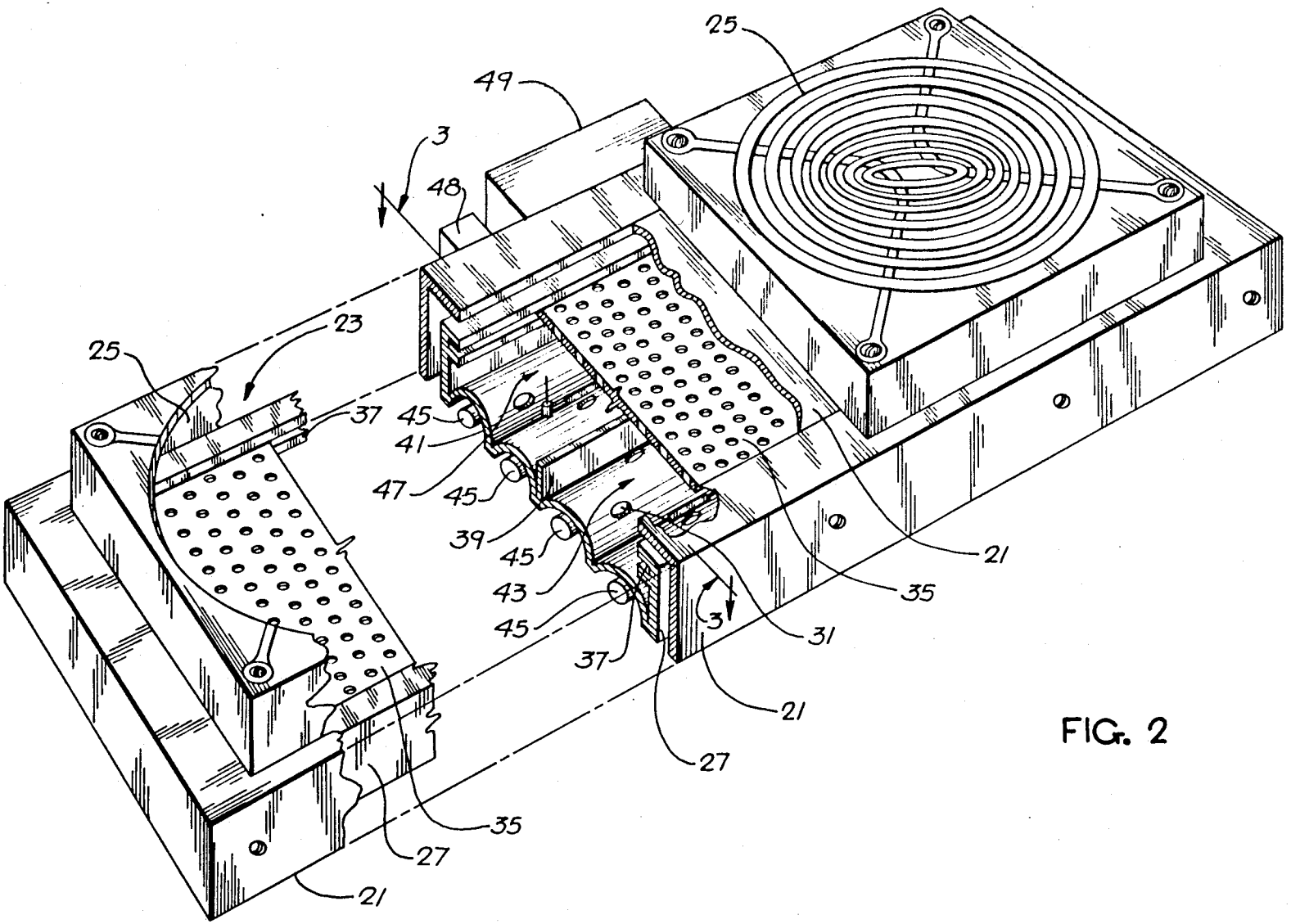
FIG. 2 is a perspective view of a light box of a preferred embodiment of the invention.

As shown in detail in FIG. 2, the light box 15 includes a housing 21 defining a plurality of openings 23. Preferably the housing 21 is made of time-savered aluminum to enhance the dissipation of heat from the surface of the housing 21. Although the housing 21 is shown as defining two openings, any number of openings may be used.

Cooling fans 25 are mounted on the housing 21 to encompass the openings 23. A preferred type of cooling fan is that manufactured by Toyo of San Gabriel, Calif., model number TF120230RXAW. Preferably, the cooling fans 25 may be activated at a low speed and at a high speed. When activated, the cooling fans 25 provide a flow of air into the housing 21.

Mounted inside the housing 21 via standoffs 26 is a reflector extrusion 27, preferably made of aluminum, which has been bright dipped and polished. The reflector extrusion 27 includes a plurality Of paraboliC reflectors 29 and a plurality of air jet holes 31 and air jet slots 33. Although four parabolic reflectors 29 are shown in FIG. 2, any number of parabolic reflectors 29 may be used. Each of the Parabolic reflectors 29 may have a radius between 0.250 and 1.25 inches. Preferably, the radius is 0.440 inches. The standoffs 26 are preferably made of aluminum and act to hold the reflector extrusion 27 in place and to thermally isolate the reflector extrusion 27 from the housing 21.

A perforated baffle 35 is positioned in grooves 37 between the parabolic reflectors 29 and the openings 23. Ridge 39 of the reflector extrusion 27 acts in conjunction with the baffle 35 to define air compartments 41, 43. The perforated baffle 35 acts to evenly disperse the flow of air from the cooling fans 25 into the air compartments 41, 43. Preferably the baffle 35 is made of black anodized aluminum, and the perforations are uniformly distributed along the surface of the baffle 35. The perforations may be between 0.125 and 0.375 inches in diameter, and are preferably 0.200 inches in diameter.

Radiant energy emitting means 45 are mounted in each of the parabolic reflectors 29 via sockets, not shown, at either end of the housing 21. The radiant energy emitting means 45 may be a fluorescent bulb, an incandescent bulb, or any other type of radiant energy emitting device. Preferably, the radiant energy emitting means 45 is an instant-on/instant-off infrared bulb manufactured by Phillips Lighting Co., Roselle, Ill., model number 137132/98. The bulbs 45 are preferably positioned at the focal point of each of the parabolic reflectors 29.

A drying area temperature probe 47 is mounted in the housing 21, preferably in the reflector extrusion 27 between adjacent parabolic reflectors 29. In addition, the probe 47 is preferably mounted to extend slightly below the reflector extrusion 27. Furthermore, the probe 47 is preferably located in a portion of the housing 21 near the printer 11, since the highest concentration of heat is found in that area under the light box 15 closest to the printer 11. The drying area temperature probe 47 produces a signal indicative of the temperature in the drying area, which is defined as that area below the reflector extrusion 27. Preferably the drying area temperature probe 47 is a fast response light gauge exposed junction thermocouple manufactured by Love Controls of Wheeling, Ill.

Overtemperature sensor 48 is mounted on the housing 21, preferably on the portion of the housing 21 closest to the printer 11. Overtemperature sensor 48 senses the temperature of the housing 21 and produces a signal that disables the press drive motor and the air pump motor of the printer 11.

Paper sensor 49 is attached to the housing 21, preferably on the portion of the housing 21 closest to the printer. The paper sensor 49 detects the presence of paper under the light box 15. The drying area temperature probe 47, the paper sensor 49, and the bulbs 45 are connected to the processing means 13 via wires, not shown.

Stack temperature probe 17 produces a signal indicating the temperature of paper which has passed under the light box 15 and has been stacked. The stack temperature probe 17 is of a type known to those skilled in the art and is inserted in the stack by an operator, not shown. The temperature signal produced by the stack temperature Probe 17 is fed to the processing means 13, which analyzes the signal and displays the sensed temperature. A preferred stack temperature probe is manufactured by Wahl Instruments of Culver City, Calif., model number TCL301.

Figure 4B:
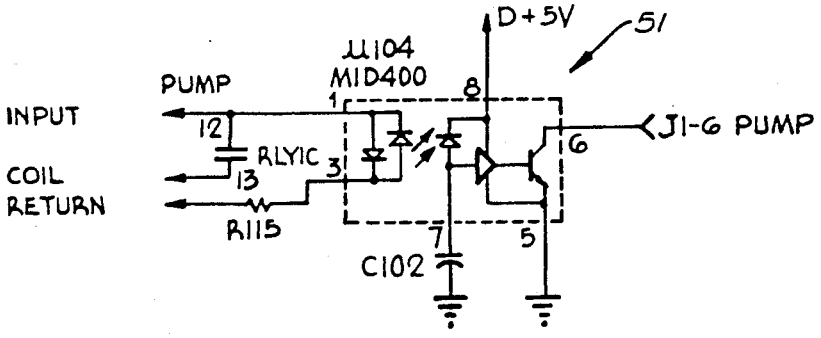
FIG. 4B is a schematic diagram of a pump circuit in a printer for use in an embodiment of the invention.
Figure 4A:
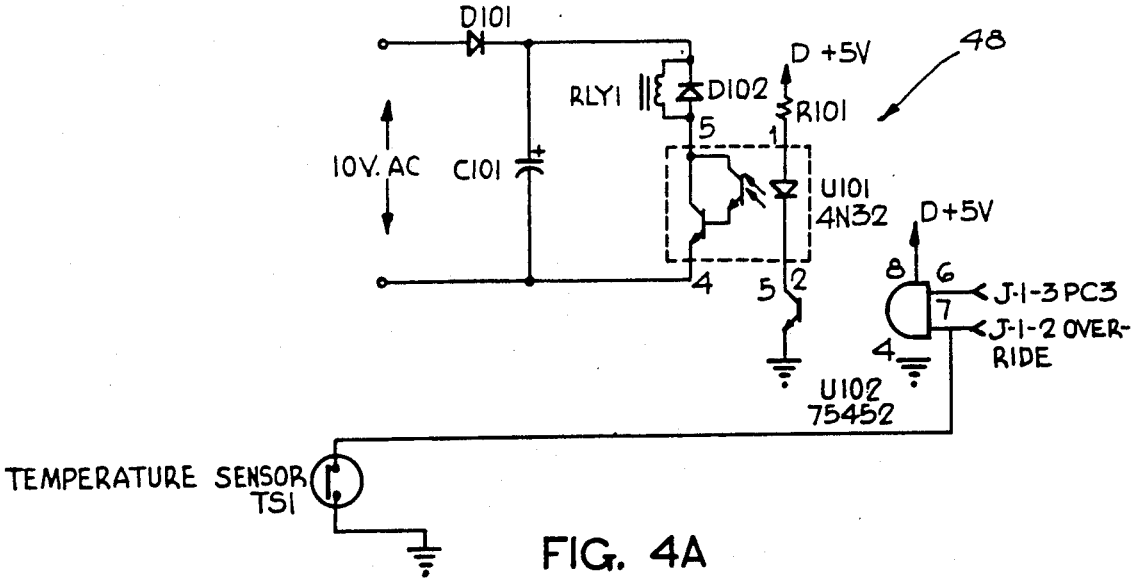
FIG. 4A is a schematic diagram of an overtemperature sensing device for use in an embodiment of the invention.

FIG. 4A is a detailed schematic diagram of the overtemperature sensor 48. The overtemperature sensor 48 includes a temperature sensor TSl which conducts when a specified temperature is exceeded. The specified temperature may vary between 130 and 150 degrees Fahrenheit and is preferably 132 degrees Fahrenheit. Preferably the temperature sensor TSl is a snap action hermetic switch manufactured by Thermo-Disc of Mansfield, Ohio, model number SAH140B. The output of the temperature sensor TSl is fed one input of an AND gate/transistor combination U102. This input is also connected to an Override line from the processing means 13. The other input of the AND gate/transistor U102 is attached to a control line PC3 from the processing means 13. When both of the inputs to the AND gate portion of this device are high, i.e. a logical "1", the transistor portion will be "on" such that the collector of the transistor portion will be only a few tenths of a volt above ground. When either of the inputs is low or a logical "0", the transistor portion will be "off" such that the collector will be floating.

The output of the AND gate/transistor U102 feeds an optical coupler U101. The optical coupler is in series with a relay coil activation circuit which includes a 10 volt a.c. source, rectifying diode D101, shunt capacitor C101, the coil of control relay RLYl, and shunt diode D103. When the optical coupler is energized (i.e when one of the inputs to the AND gate/transistor U102 is low), the relay coil activation circuit is energized, and the coil of control relay RLYl is energized.

FIG. 4B shows, in detail, an air pump motor activation and status indication circuit 51. This circuit provides a pump output signal indicating the status of the air pump motor of the printer 11. In a manner known to those skilled in the art, the air pump provides air to the printer 11 for the feeding of paper. The circuit 51 is connected to the power source for the pump via the Coil and Return lines. The Input line is connected to the coil of an air pump activating relay. The air pump can only be activated when power is present on the Input line.

The Coil line is attached to the input terminal via contacts RLYlc of relay RLl. Only when the contacts RLYlc are closed and there is power on the Coil line will power be present on the Input line. Therefore, when the coil of relay RLYl is not energized, the contacts RLYlc will not be closed, and the air pump cannot be activated.

The Input and Return lines feed optical coupler U105 via resistor R115, which is chosen in a manner known to those skilled in the art based on the type of printer employed with the dryer. The optical coupler U105 produces a high signal on the Pump status line when current is flowing between the Input and Return lines. In other words, when there is power to the air pump activating relay, the signal on the Pump status line will be high. When there is no power to the air pump activating relay, the signal on the Pump status line will be low. Capacitor C102 is connected between the optical coupler U105 and ground to control the operational characteristics of the optical coupler in a manner known in the art.

Circuitry identical to that of the air pump motor activation and status indication circuitry is also used to generate the Press status signal indicating the status of the press drive motor of the printer 11, and to control the activation of the press drive motor. In a manner known to those skilled in the art, the press drive motor provides the motive power required to actually operate the press of the printer 11.

Figure 5:
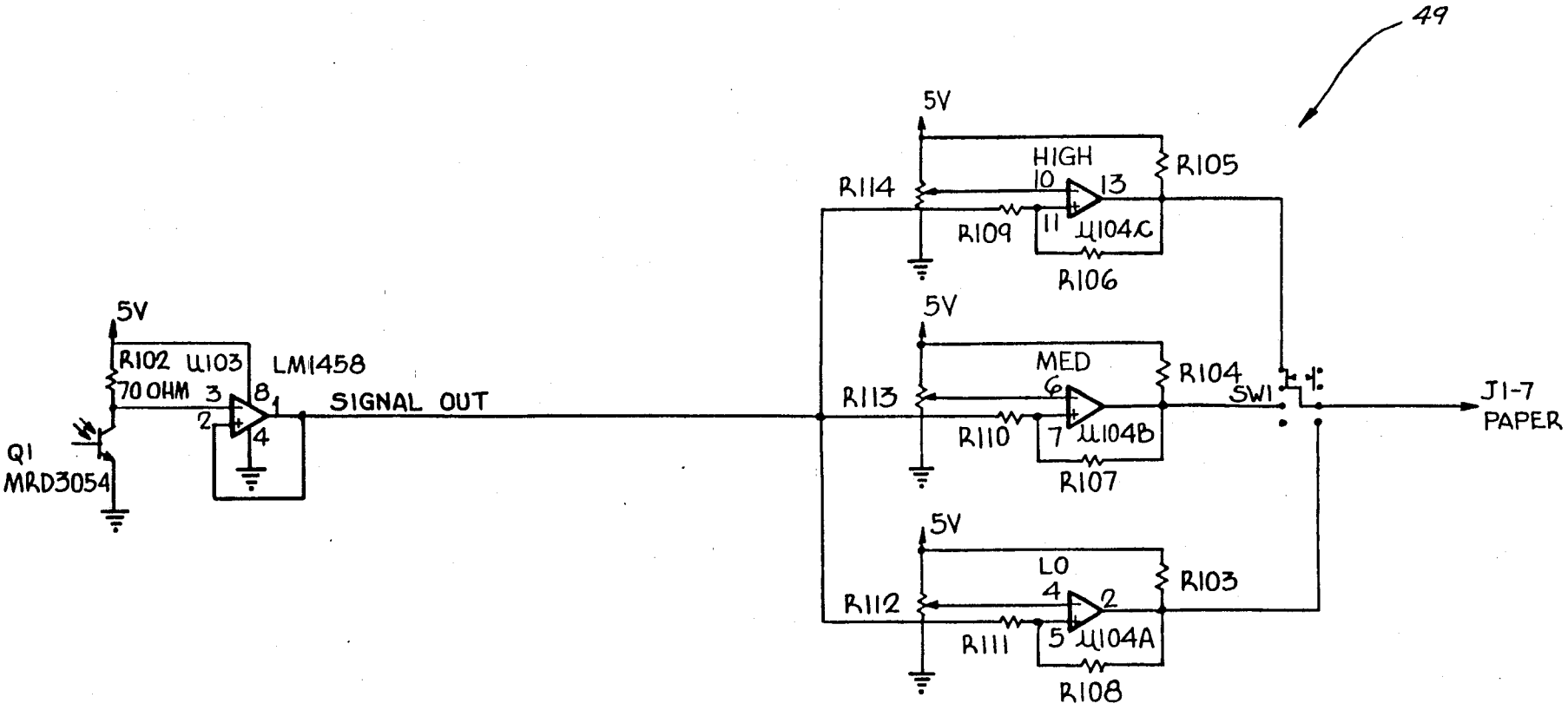
FIG. 5 is a schematic diagram of a paper sensing device for use in an embodiment of the invention.

FIG. 5 is a detailed schematic diagram of the preferred paper sensor 49. The paper sensor includes a phototransistor Ql whose collector is attached to a 5 volt d.c. power source via resistor Rl and whose emitter is grounded. The collector of Ql is connected to operational amplifier U103 which is configured as a voltage follower. The output of operational amplifier U103 is fed to three comparator circuits. Each comparator circuit includes an operational amplifier U104A, U104B, U104C, and a potentiometer R112, R113, R114 for setting the reference voltage at the inverting input of each corresponding operational amplifier. One of the three outputs of the operational amplifiers U104A, U104B, U104C is chosen to be the paper sensing signal transmitted to the processing means 13. In this manner, the sensitivity of the paper sensor 49 can be adjusted based on the radiation emitted from the bulbs 45.

As shown in FIG. 5, the paper sensing signal is chosen by positioning switch SW1. However, other means for choosing the paper sensing signal may be used. For example, a multiplexer controlled by the processing means 13 may be used to choose the proper signal. The processing means 13 could choose the proper signal based on the signal it produces to control the intensity of the radiation emitted from the bulbs 45.

Figure 6:
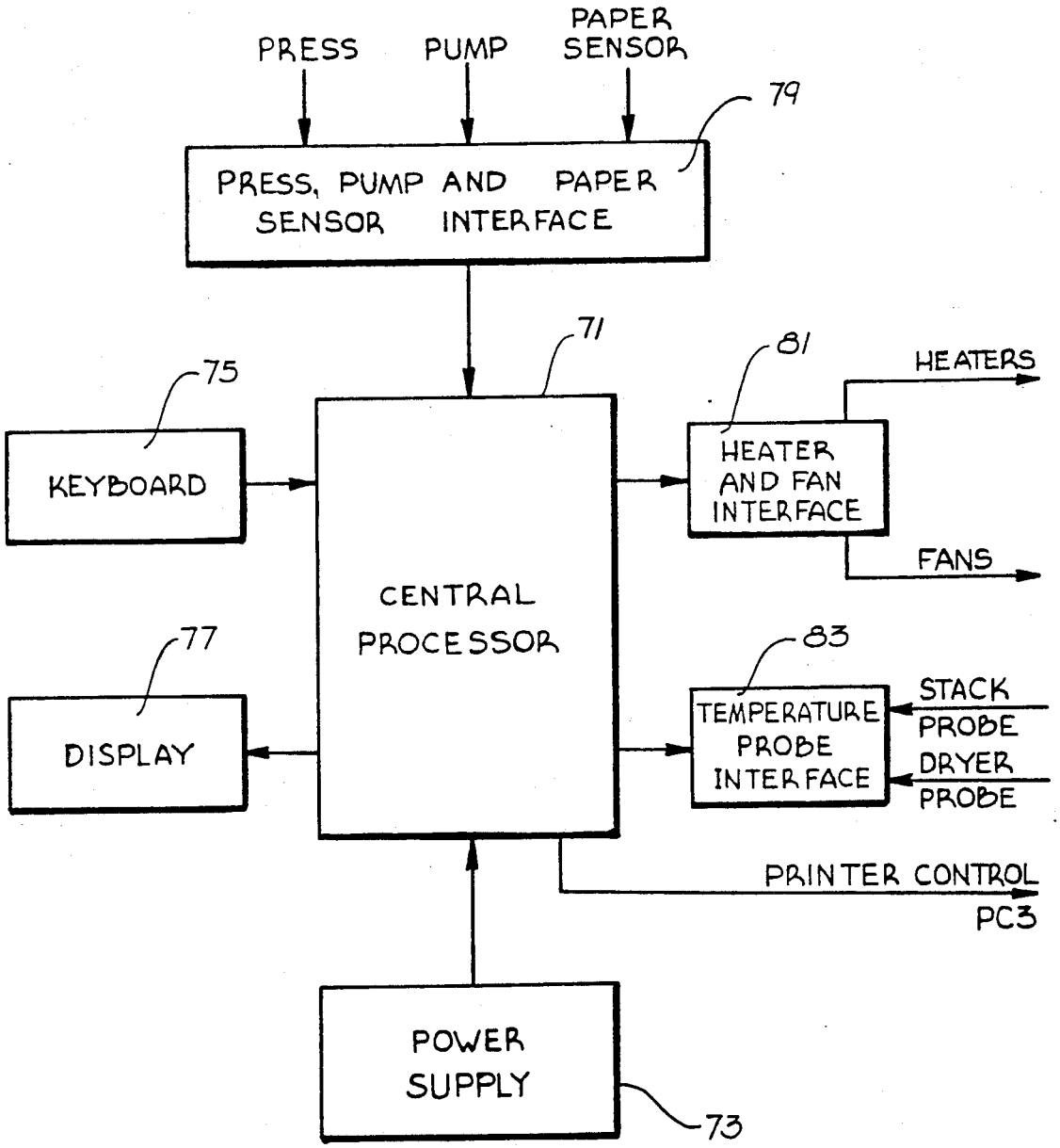
FIG. 6 is a block diagram of the processing means shown in FIG. 1.
Figure 7A:
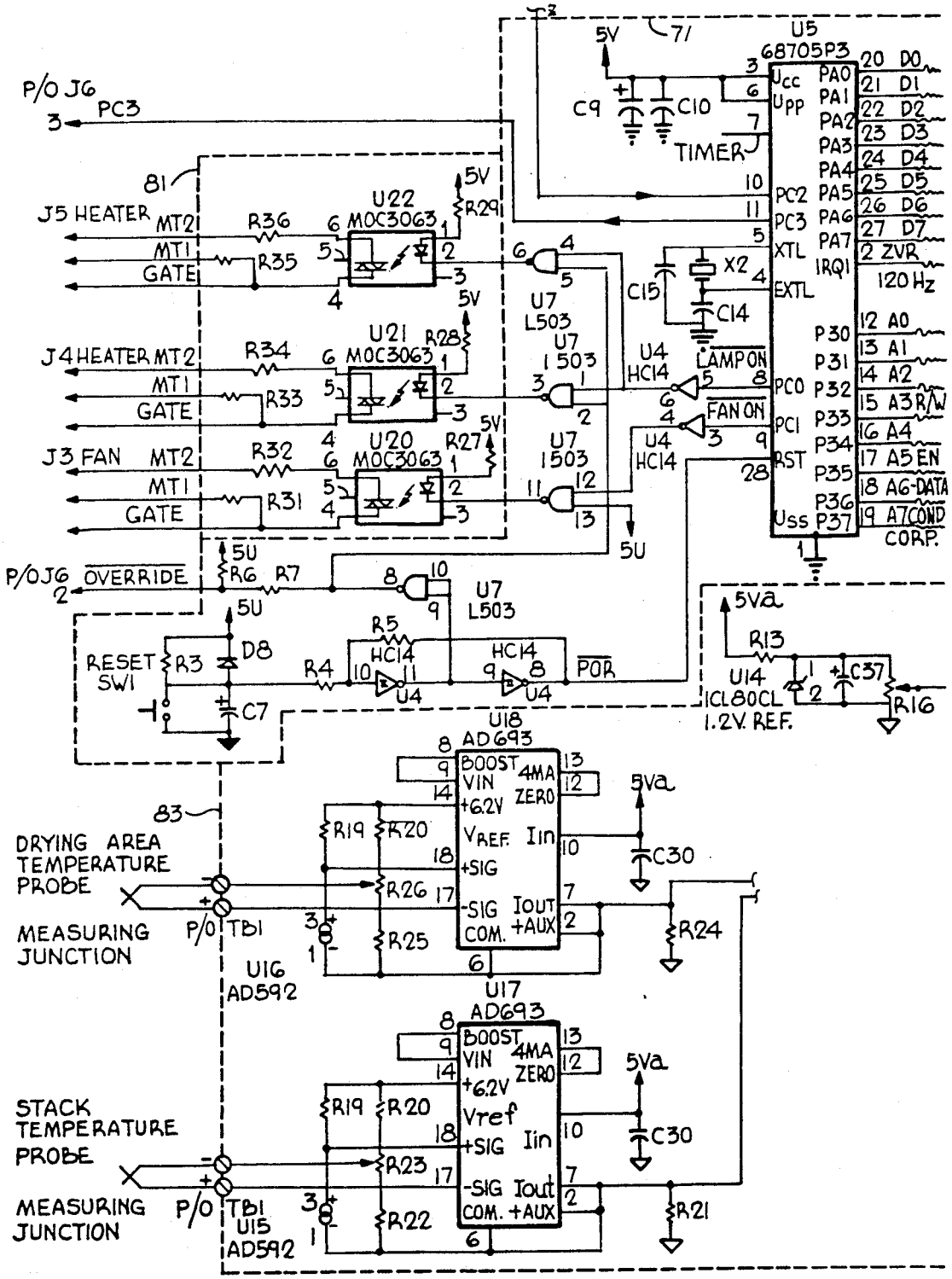
FIGS. 7A–F are a schematic diagram of the processing means of an embodiment of the invention.
Figure 7B:
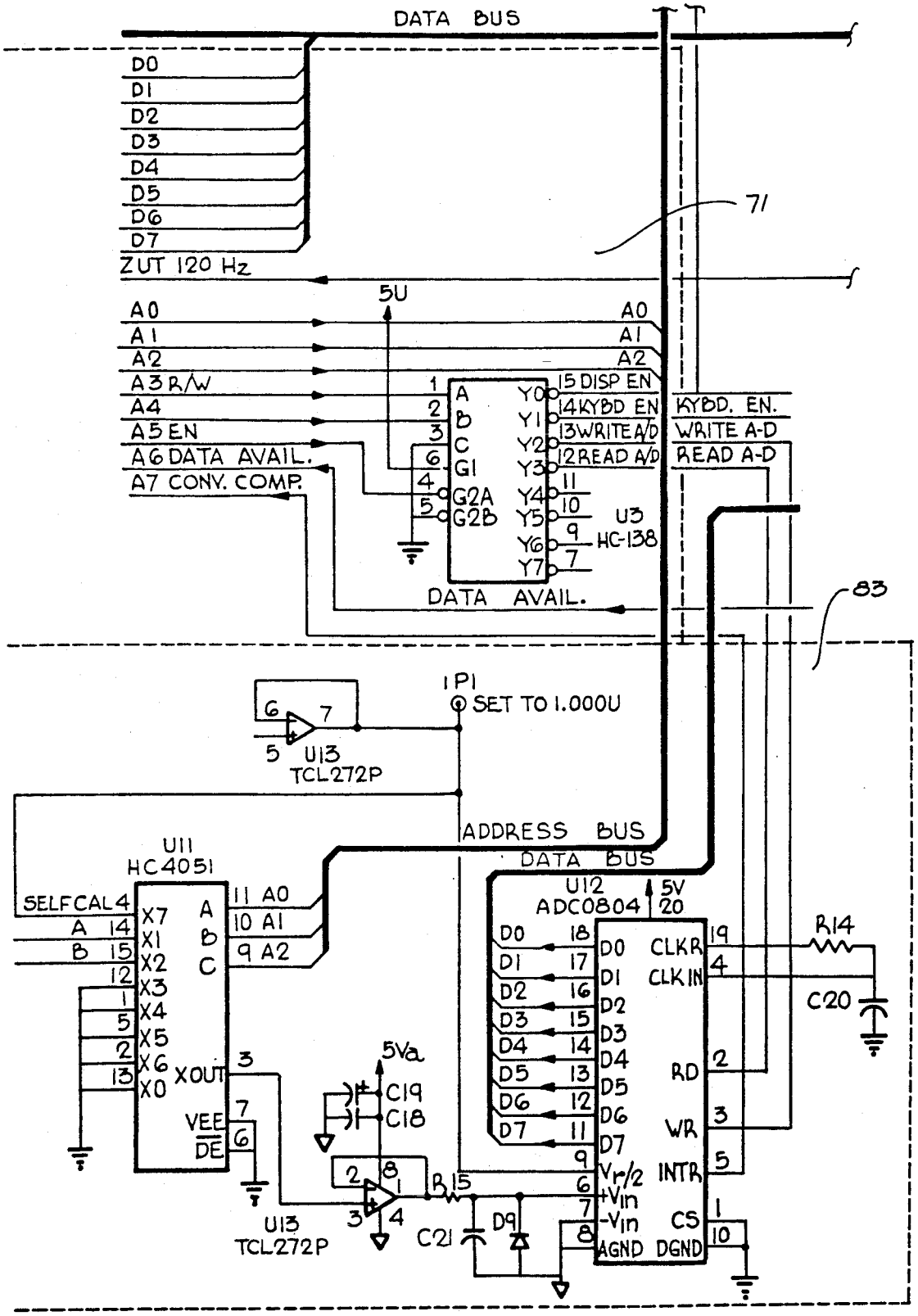
Figure 7C:
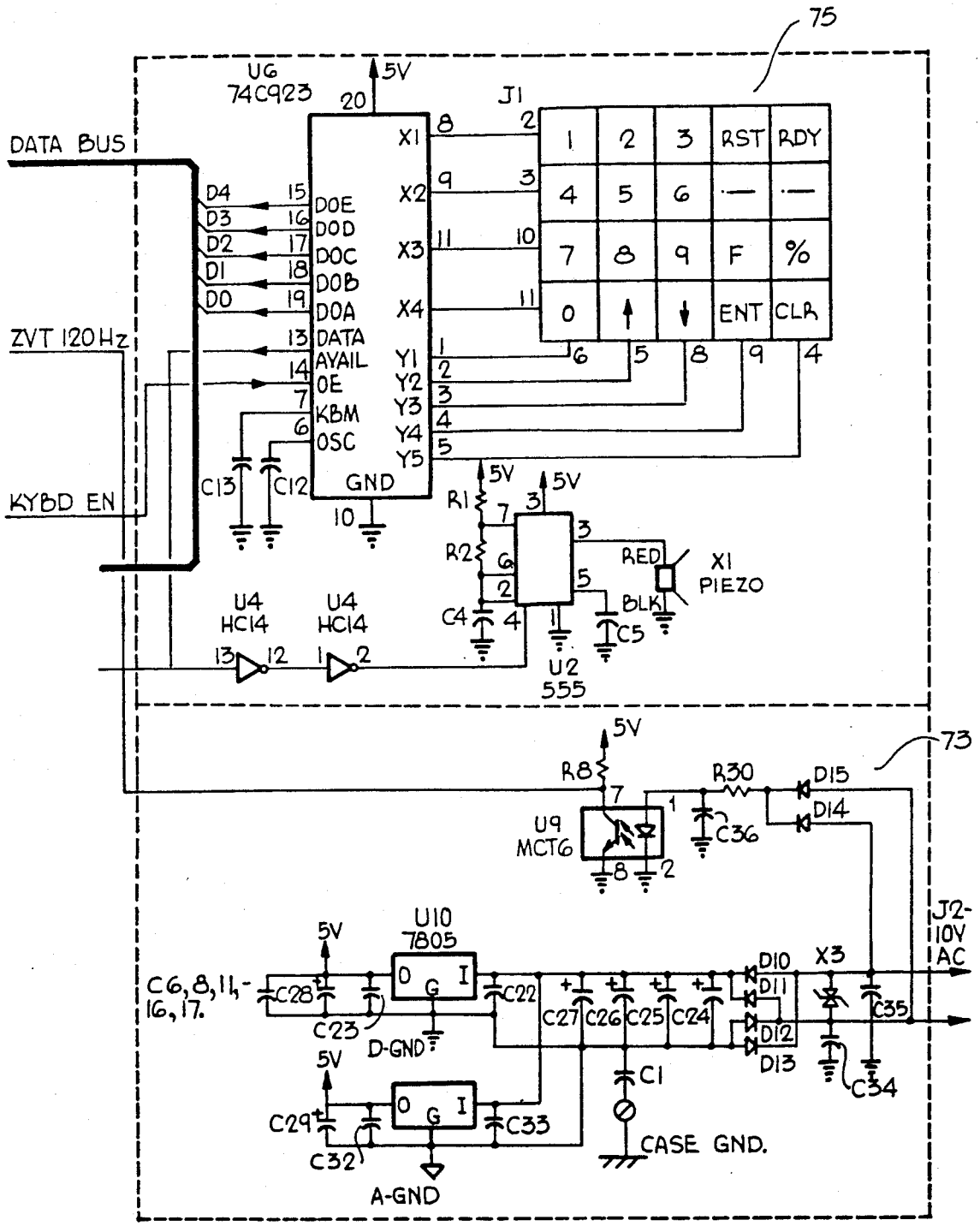
Figure 7D:
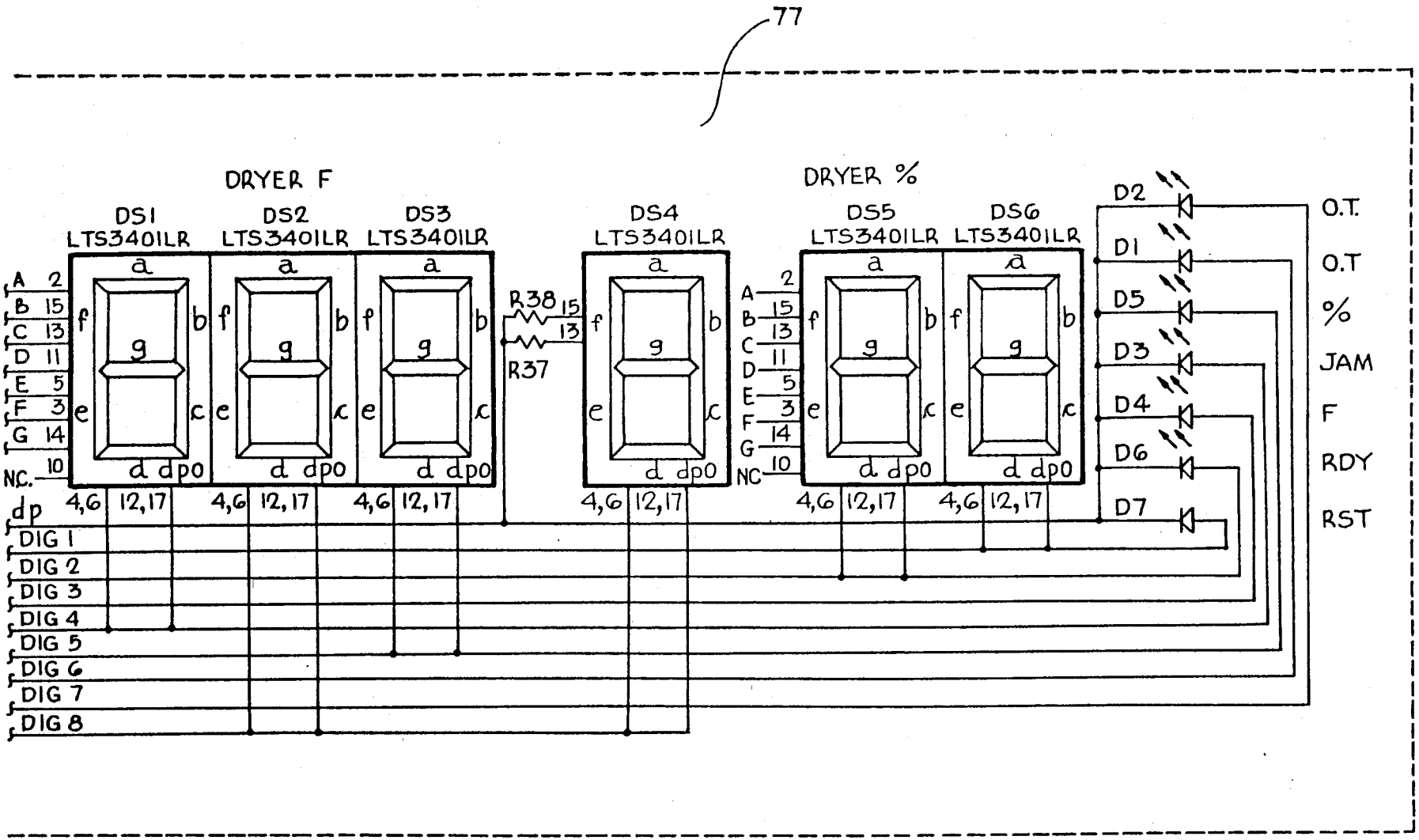
Figure 7E:
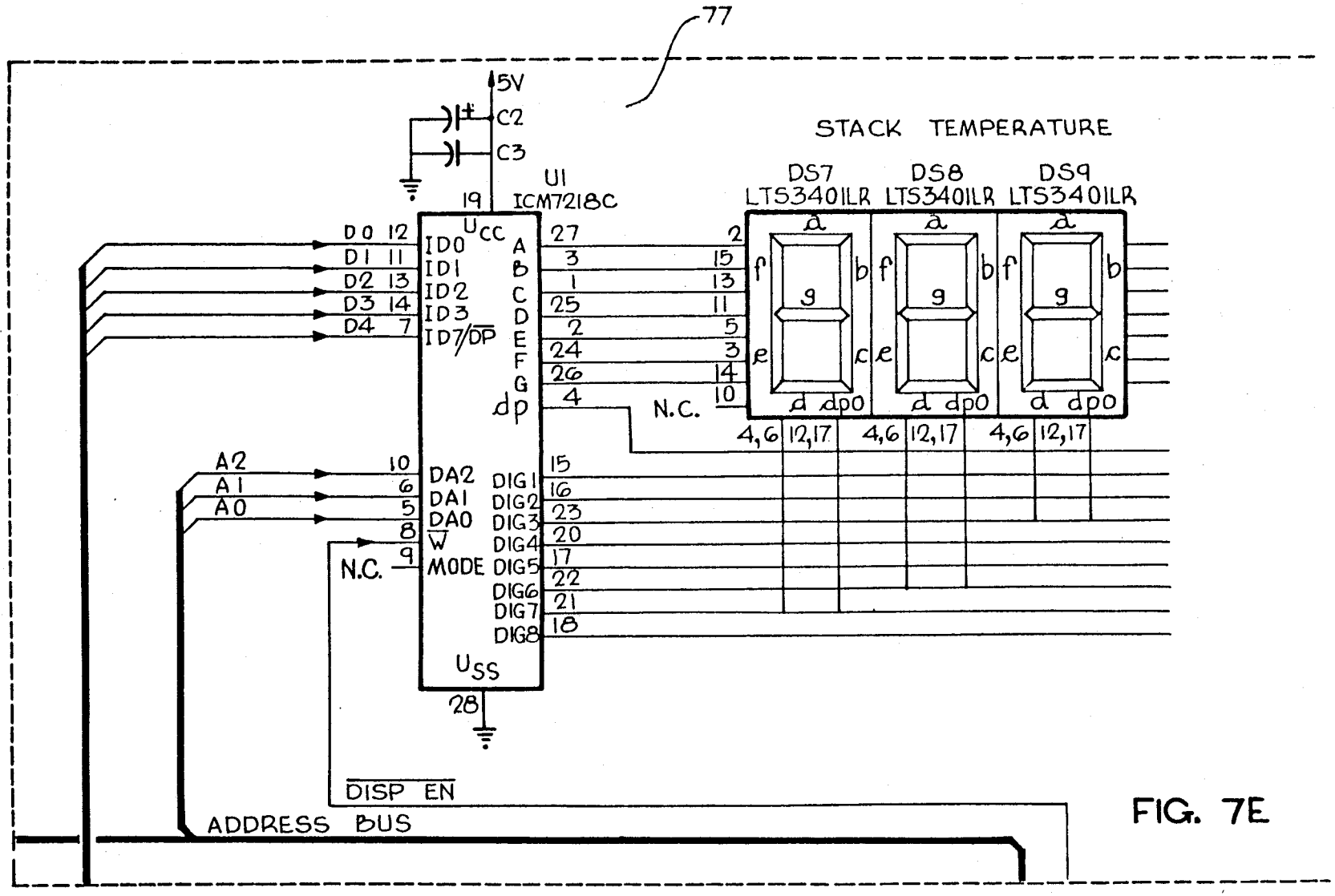
Figure 7F:
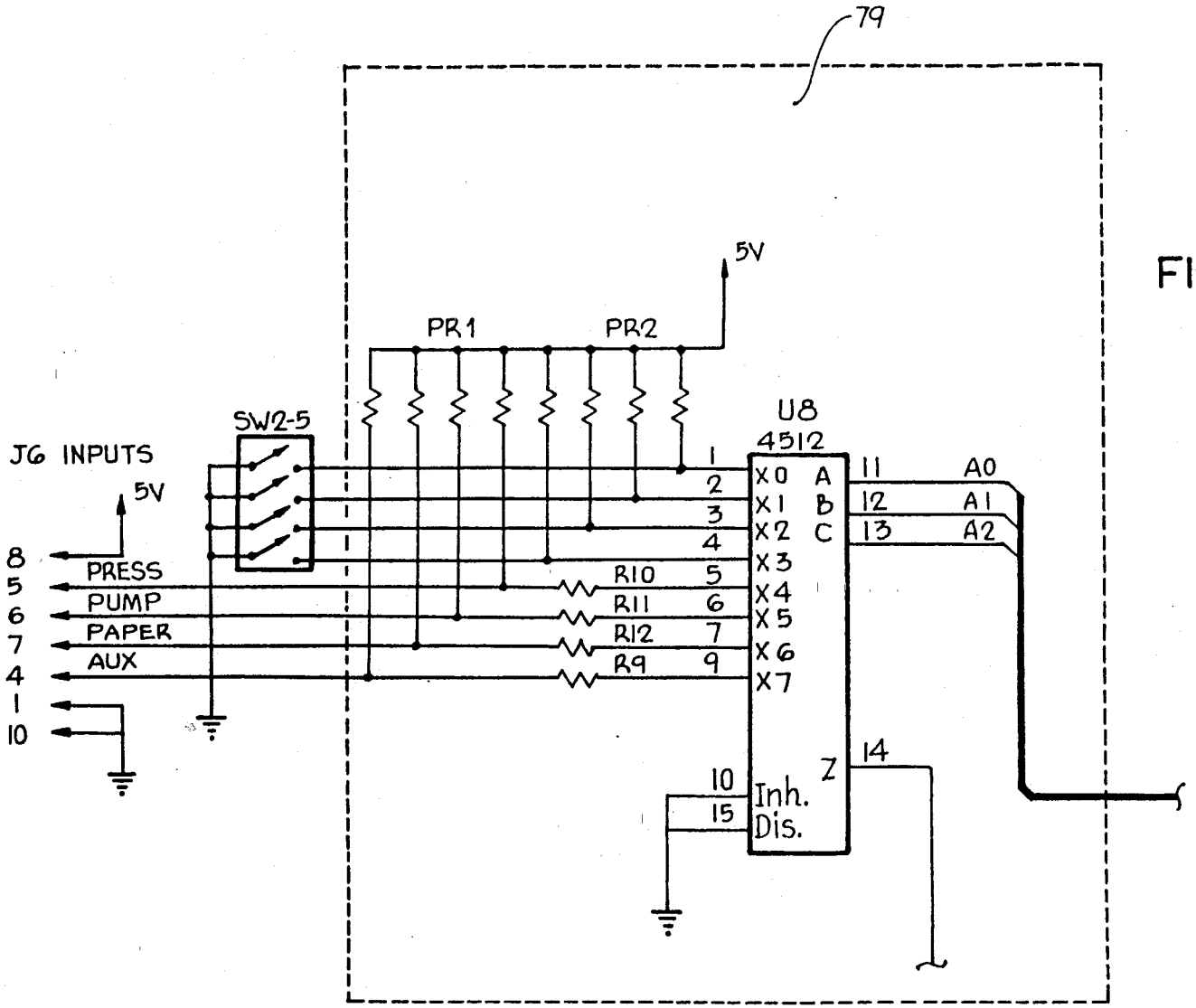

As shown in FIG. 6, the processing means 13 includes a central processor 71, which is powered by a power supply 73. A keyboard 75 allows information to be entered directly to the central processor 71. Display 77 is controlled by the central processor 71 and indicates the operational status of the dryer, as well as the temperatures sensed by the stack temperature probe 17 and the dryer probe. The central processor 71 receives the temperature signals from the stack temperature probe 17 and the dryer area temperature probe 47 via temperature probe interface 83. The press status signal, the pump status signal, and the paper sensor signal are fed to the central processor via interface 79. The radiant energy emitting means 45 and the cooling fans 25 are activated by the central processor 71 via interface 81.

The central processor executes a computer program for controlling the operation of the dryer. A listing of a preferred assembly language computer program for use with the preferred central processor 71 of the processing means 13 is attached to this specification and should be considered as part of this specification. Those skilled in the art will recognize that other computer programs may be used in conjunction with the processing means 13 to accomplish the tasks and provide the operational characteristics disclosed herein.

FIGS. 7A-F show a detailed schematic of a preferred processing means 13. FIGS. 7A-F are designed to be arranged as shown in FIG. 7. The detailed schematic diagram of FIGS. 7A-F is believed to be self-explanatory to those skilled in the art and therefore a discussion of each individual component is believed unnecessary.

For completeness in the disclosure of the present invention, but not for purposes of limitation, the following component identifications are submitted for FIGs. 4A, 4B, 5, and 7A-F. All capacitor values are in microfarads, unless otherwise noted. All resistors are ¼ watt with 5% tolerance, and have values expressed in ohms, unless otherwise noted. Those skilled in the art will recognize that alternative components and values to those listed may be employed in constructing the circuit in accordance with the present invention. Indeed, those skilled in the art will recognize that other devices and circuitry may be employed to accomplish the same tasks and provide the same operational characteristics as the devices and circuitry disclosed herein.

| PART NO. | IDENTIFICATION AND PRODUCT NO. | MANUFACTURER |
|---|---|---|
| U1 | Display ICM7218C | Intersil |
| U2 | Timer NE555 | National |
| U3 | 3 to 8 Decoder 74HC138 | Motorola |
| U4 | Inverters 74HC14 | Motorola |
| U5 | Microprocessor 68705P3 | Motorola |
| U6 | Decoder 74C923 | National |
| U7 | Nand Gates 74LS03 | Motorola |
| U8 | Multiplexer 4512 | Motorola |
| U9 | Opto-Isolator MCT6 | Motorola |
| U10 | 5 v. Regulator 7805 | National |
| U11 | Multiplexer 74HC4051 | Motorola |
| U12 | ADC ADC0804 | Analog Devices |
| U13 | Op Amp TL0272P | Texas Instruments |
| U14 | 1.2 v. Ref. ICL8069 | Intersil |
| U15,U16 | I Source AD592 | Analog Devices |
| U17,U18 | I Sense AD693 | Analog Devices |
| U19 | 5 v. Regulator 78L05 | National |
| U20-22 | Opto-Isolator MOC3063 or MOC3023 | Motorola |
| U101 | Optical Coupler 4N32 | Motorola |
| U102 | AND gate/Transistor 75452 | Motorola |
| U103 | Operational Amplifier LM 1458 | Motorola |
| U104 | Operational Amplifier LM339N | Motorola |
| U105 | Optical Coupler MID400 | General Instruments |
| Q1 | Phototransistor MRD3054 | Motorola |
| D1-7 | L.E.D. | Rohm |
| D8,D9 | Diode 1N148 | Motorola |
| D10-15 | Diode 1N4003 | Motorola |
| D101,D102 | Diode 1N4004 | Motorola |
| DS1-9 | Display LTS3401LR | Lite-On |
| X1 | Piezo. Buzzer | Mega PTW |
| X2 | 4.000 MHZ HC-18U | Fox |
| C1 | 0.01, 50 v. Film Cap. | Central Lab |
| C2,7,9,13, 19,37 | 10, 16 v. Tant. Cap. | Central Lab |
| C3,5,6,8,10, 11,12,16,17, 18,22,23,30, 31,32,33,34, 35 | 0.1, 50 v. Cer. Cap. | Central Lab |
| C4 | .0082, 16 v. Cer. Cap. | Central Lab |
| C14,C15 | 22 pF Cer. Cap. | Central Lab |
| C20 | 150 pF Cer. Cap. | Central Lab |
| C21,C36 | 220 pF Cer. Cap. | Central Lab |
| C24-28 | 470, 16 v. Electrolytic Cap. | Central Lab |
| C29 | 22, 16 v. Tant. Cap. | Central Lab |
| C101 | 220, 16 v. Electrolytic Cap. | Central Lab |
| C102 | .1, 50 v. Cer. Cap. | Central Lab |
| R1,9-12,15 | 1 K Resistor | Stack Pole |
| R2 | 4.7 K Resistor | Stack Pole |
| R3,R4 | 100 K Resistor | Stack Pole |
| R5 | 10 Meg Resistor | Stack Pole |
| R8,R14 | 10 K Resistor | Stack Pole |
| R13 | 6.8 K Resistor | Stack Pole |

-continued

| PART NO. | IDENTIFICATION AND PRODUCT NO. | MANUFACTURER |
|---|---|---|
| R16 | 10 K Pot. | Stack Pole |
| R17,R19 | 51.7 1% Resistor | Stack Pole |
| R18,R20 | 665 1% Resistor | Stack Pole |
| R21,R24 | 180 1% Resistor | Stack Pole |
| R22,R25 | 301 K 1% Resistor | Stack Pole |
| R23,R26 | 50 Pot. | Stack Pole |
| R27-29 | 270 Resistor | Stack Pole |
| R30 | 1.5 K Resistor | Stack Pole |
| R31,33,35 | 1 K ½ w. Resistor | Stack Pole |
| R32,34,36 | 180 ½ w. Resistor | Stack Pole |
| R37,R38 | 27 Resistor | Stack Pole |
| R101 | 220 Resistor | Stack Pole |
| R102 | 70 Resistor | Stack Pole |
| R103-105 | 31 K Resistor | Stack Pole |
| R106-108 | 10 M Resistor | Stack Pole |
| R109-111 | 10 K Resistor | Stack Pole |
| R112-114 | 5 K Multiturn Pot. CT9W-5 k Pot. | Stack Pole |
| R115 | 1 W. Resistor | Stack Pole |
| PR1,PR2 | 10K × 4 SIP Resistor | Stack Pole |
| RLY1 | Relay R10-E1-Y-4-V185 | P & B |

Turning now to the operation of the ink drying device, the light box 15 produces radiant heat energy due to the infrared bulbs 45. The energy emitter by the bulbs 45 is reflected from the parabolic reflectors 29 to a point underneath the light box 15. Air flowing from the cooling fans 25 is evenly distributed into air compartments 41 and 43 by the perforated baffle 35. The air in each air compartment acts to cool the reflector extrusion by forcing air through the air jet holes 31 and the air jet slots 33.

When printed material exits the printer 11 it is transported under the light box 15 by any suitable means, such as a continuous conveyor. As the printed material passes under the light box 15 the radiant energy from the infrared bulbs 45 and the hot air forced through the air jet holes 31 and air jet slots 33 heat the ink on the printed material, thereby causing the initial setting of the ink. In addition, the air forced out of the air jet holes 31 and the air jet slots 33 acts to hold the printed material down flat as it passes under the light box 15.

After passing under the light box 15, the printed material continues down the transporting means and is stacked with other recently printed material. The ink continues to set due to the heat of the stacked material and eventually is permanently set.

Stack temperature probe 17 is manually inserted into the stack of printed material and the processing means 13 displays the temperature of the stack. By varying the heat generated by the light box 15, the stack temperature may be controlled and thus the time necessary for the ink to finally set may be controlled.

The processing means 13 is programmed to activate the cooling fans 25 in a low speed mode when the drying device is activated. In a first operational mode, which is selected by an operator via keyboard 83, the processing means senses the temperature in the drying area via temperature probe 47 and activates the cooling fans 25 in a high speed mode when the sensed temperature exceeds a predetermined high threshold temperature. In addition, the processing means 13 may be programmed to reactivate the cooling fans 25 in a slow speed mode when the temperature sensed by the drying area temperature probe 47 falls below a predetermined low threshold temperature. Both the high temperature threshold and the low temperature threshold can be entered into the processing means 13 via keyboard 83. Preferably the predetermined high threshold temperature is 90 degrees Fahrenheit and the predetermined low threshold temperature is 85 degrees Fahrenheit.

In a second mode of operation, which is selected by an operator via keyboard 83, the processing means 13 adjusts the radiation from the infrared bulbs 45. Since bulbs 45 are instant on/instant off bulbs, by pulsing the bulbs on and off at selected rates, the overall intensity of the radiation from the bulbs 45 may be controlled. The processing means 13 is preferably programmed to adjust the signal on the Lamp On line of FIG. 5A. When the Lamp on signal is low, the bulbs 45 will be on, when the Lamp on signal is high, the bulbs 45 will be off. Thus by controlling the duty cycle of the signal on the Lamp on line, the radiant energy emitted by the bulbs 45 may be controlled.

Preferably, an operator enters the percentage of radiation desired to be emitted from the bulbs 45 via keyboard 75, where 0 percent is no radiation and 100 percent is the maximum radiation possible from the bulbs 45. The entered percentage is then displayed on the display 77 and the central processor 71 acts to control the signal on the Lamp On line to produce the desired percentage of radiation. The program necessary to accomplish this control function is readily ascertainable by one of ordinary skill in the art.

To increase the safety of an operator using the printer and dryer, the processing means 13 senses whether the press and pump of the printer 11 are operating and will not allow the dryer to be operated unless the press and the pump are operating. When the press or the pump have power and are operating, a high signal is transmitted to the processing means 13 via appropriate interface circuitry, as shown in FIG. 5F. The processing means 13 is programmed not to turn the bulbs 45 on unless a high signal is present on the Press and the Pump lines. In this way the life of the bulbs 45 is conserved and the operator will not inadvertently start the dryer.

The processing means 13 is also programmed, in a manner known in the art, to sense the output of the paper sensor 49. If the processing means 13 senses that paper has continuously been present under the light box 15 for a predetermined amount of time, preferably 2 seconds, the processing means will automatically turn off the bulbs 45 by maintaining the signal on the Lamp On line high, and will disable the press and pump of the printer by maintaining the signal on the PC3 line low.

If, during the operation of the dryer, the operator wishes to stop the operation of the dryer, he may do so by depressing the Reset switch SW1. When the reset switch SW1 is depressed, a low signal is sent over the Override line and the press and pump of the printer 11 are disabled and the microprocessor U5 is reset.

Of course it should be understood that various changes and modifications to the preferred embodiment described herein will be apparent to those skilled in the art. Such changes and modifications can be made without departing from the scope of the present invention and without diminishing its attendant advantages. It is, therefore, intended that such changes and modifications be covered by the following claims.

As referenced earlier, the following is a listing of a preferred computer assembly language program for use with the preferred central processor 71 and should be considered part of this specification.

We claim:

1. An ink drying device comprising:

a light box for emitting radiation, said infrared radiation drying said ink on said paper;

a cooling fan for cooling said light box;

processing means for controlling the emission of infrared radiation from said light box and for controlling said cooling fan;

temperature sensing means for sensing the temperature of a drying area defined about said light box and transmitting a temperature signal representing the temperature of said light box to said processing means;

sensing mean for determining the presence of said paper in the vicinity of said ink drying device and transmitting a paper sensing signal to said processing means indicative of the presence of said paper in the vicinity of said ink drying device;

wherein said processing means adjusts the operation of said cooling fan when said temperature signal is above a first predetermined threshold and controls the operation of said printer based on said paper sensing signal.

2. The device of claim 1 wherein said processing means deactivates said cooling fan when said temperature signal is below a predetermined threshold.

3. The device of claim 1 wherein said processing means readjusts the operation of said cooling fan when said temperature signal is below a second predetermined threshold.

4. The device of claim 1 wherein said processing means controls the operation of said printer based on the operational status of the light box.

5. The device of claim 1 wherein said paper is passed under said light box and wherein said ink drying device further includes means for maintaining said paper substantially flat when said paper is under said light box.

6. The device of claim 5 wherein said means for maintaining said paper substantially flat includes means for forcing air upon said paper.

7. The device of claim 1 wherein said drying area ia defined as below said light box.

8. An ink drying device for drying ink on paper which has been printed on said paper by a printer, said ink drying device comprising:

a light box including a housing;

temperature sensing means for sensing the temperature of said housing and producing a signal indicative of the temperature of said housing;

a cooling fan for cooling said housing; and means for deactivating said printer in response to said signal indicative of the temperature of said housing.

9. The device of claim 8 wherein said printer includes a press drive motor and wherein deactivating means includes means for deactivating said press drive motor.

10. The device of claim 8 wherein said printer includes an air pump motor and wherein said deactivating means includes means for deactivating said air pump motor.

* * * * *